US010139751B2

(12) United States Patent
Yamamoto et al.

(10) Patent No.: US 10,139,751 B2
(45) Date of Patent: Nov. 27, 2018

(54) IMAGE FORMATION APPARATUS DETECTING A RESPONSE FROM COMMUNICATION PART

(71) Applicant: Oki Data Corporation, Tokyo (JP)

(72) Inventors: Satoshi Yamamoto, Tokyo (JP); Yoichi Hayakawa, Tokyo (JP); Kentaro Hasegawa, Tokyo (JP); Masahiko Hoshino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 3 days.

(21) Appl. No.: 15/620,975

(22) Filed: Jun. 13, 2017

(65) Prior Publication Data

US 2017/0371265 A1 Dec. 28, 2017

(30) Foreign Application Priority Data

Jun. 27, 2016 (JP) ..... 2016-126889

(51) Int. Cl.

| | |
|---|---|
| ***G03G 15/08*** | (2006.01) |
| ***G03G 21/16*** | (2006.01) |
| ***G03G 21/18*** | (2006.01) |
| ***G03G 15/00*** | (2006.01) |

(52) U.S. Cl.

CPC ..... *G03G 15/0863* (2013.01); *G03G 15/0849* (2013.01); *G03G 15/50* (2013.01); *G03G 15/553* (2013.01); *G03G 21/1657* (2013.01); *G03G 21/1892* (2013.01); *G03G 2221/16* (2013.01)

(58) Field of Classification Search

CPC .. G03G 15/50; G03G 15/0258; G03G 15/553; G03G 15/0849; G03G 15/0863; G03G 21/1657; G03G 21/1892

See application file for complete search history.

(56) References Cited

U.S. PATENT DOCUMENTS 8,106,767 B2 * 1/2012 Okada ..... G03G 15/0855 340/10.4

FOREIGN PATENT DOCUMENTS

JP 2012-230237 A 11/2012

* cited by examiner

*Primary Examiner* — David M Gray
*Assistant Examiner* — Andrew V Do
(74) *Attorney, Agent, or Firm* — Metrolexis Law Group, PLLC

(57) ABSTRACT

An image formation apparatus according to one or more embodiments includes: an engagement part to which a replacement unit with a first communication part is detachably attachable; a second communication part configured, in a state where the replacement unit is attached to the engagement part, to communicate wirelessly with the first communication part of the replacement unit; and a control unit programmed to control the second communication part. In a process of causing the second communication part to communicate wirelessly with the first communication part a plurality of times, the control unit detects a change in a response from the first communication part.

18 Claims, 11 Drawing Sheets

Fig. 6

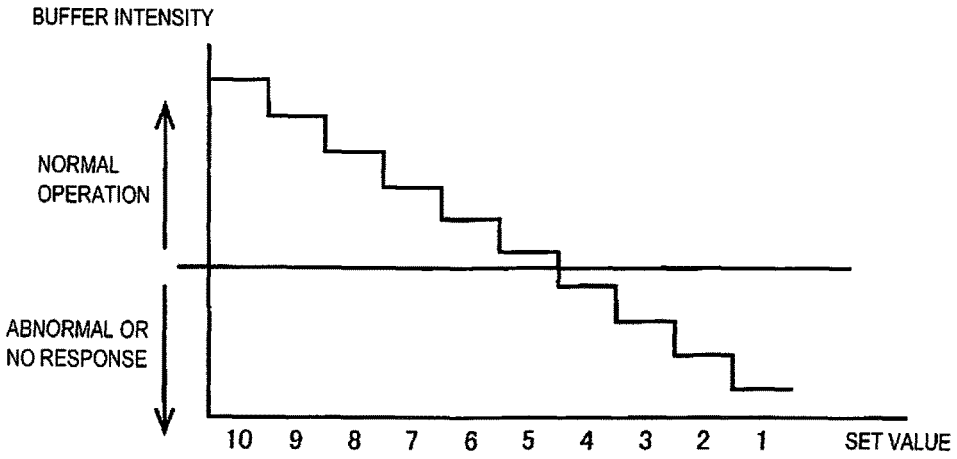

Fig. 7

| VALUE SET FOR BUFFER INTENSITY | RESPONSE FROM GENUINE PART | RESPONSE FROM NON-GENUINE PART |
|---|---|---|
| 10 | NORMAL | NORMAL |
| 9 | NORMAL | NORMAL |
| 8 | NORMAL | NORMAL |
| 7 | NORMAL | NORMAL |
| 6 | NORMAL | ABNORMAL OR NO RESPONSE |
| 5 | NORMAL | ABNORMAL OR NO RESPONSE |
| 4 | ABNORMAL OR NO RESPONSE | ABNORMAL OR NO RESPONSE |
| 3 | ABNORMAL OR NO RESPONSE | ABNORMAL OR NO RESPONSE |
| 2 | ABNORMAL OR NO RESPONSE | ABNORMAL OR NO RESPONSE |
| 1 | ABNORMAL OR NO RESPONSE | ABNORMAL OR NO RESPONSE |

Fig. 8

| VALUE SET FOR BUFFER INTENSITY | RESPONSE FROM GENUINE PART | RESPONSE FROM NON-GENUINE PART |
|---|---|---|
| 10 | NORMAL | NORMAL |
| 9 | NORMAL | NORMAL |
| 8 | NORMAL | NORMAL |
| 7 | NORMAL | NORMAL |
| 6 | NORMAL | NORMAL |
| 5 | NORMAL | NORMAL |
| 4 | ABNORMAL OR NO RESPONSE | NORMAL |
| 3 | ABNORMAL OR NO RESPONSE | NORMAL |
| 2 | ABNORMAL OR NO RESPONSE | ABNORMAL OR NO RESPONSE |
| 1 | ABNORMAL OR NO RESPONSE | ABNORMAL OR NO RESPONSE |

Fig. 12

| TIME (MINUTES) FOR AUTHENTICATION MODE | RESPONSE FROM RFID TAG |
|---|---|
| 15 | NORMAL |
| 30 | NORMAL |
| 45 | NORMAL |
| 60 | NORMAL |
| 75 | NORMAL |
| 90 | NORMAL |
| 105 | NORMAL |
| 120 | ABNORMAL OR NO RESPONSE |
| 135 | ABNORMAL OR NO RESPONSE |
| 150 | ABNORMAL OR NO RESPONSE |

IMAGE FORMATION APPARATUS DETECTING A RESPONSE FROM COMMUNICATION PART

CROSS REFERENCE TO RELATED APPLICATIONS

This application claims priority based on 35 USC 119 from prior Japanese Patent Application No. 2016-126889 filed on Jun. 27, 2016, entitled "IMAGE FORMATION APPARATUS", the entire contents of which are incorporated herein by reference.

BACKGROUND

1. Field

The disclosure relates to an image formation apparatus to which a replacement unit can be detachably attached.

2. Description of Related Art

In a related art, there is an image formation apparatus which reads and writes management information on a replacement unit or the like by using a non-contact memory (see Japanese Patent Application Publication No. 2012-230237, for example).

SUMMARY

In the image formation apparatus, however, proper maintenance is sometimes difficult because of difficulty in making a genuineness determination for determining whether a replacement unit or the like attached thereto is a non-genuine part or a genuine part.

An object of an embodiment of the invention is to enable proper maintenance of an image formation apparatus by improving accuracy of determining whether a replacement unit is genuine.

An aspect of the invention is an image formation apparatus to which a replacement unit with a first communication part is detachably attachable. The image formation apparatus includes: a second communication part configured, in a state where the replacement unit is attached to the image formation apparatus, to communicate wirelessly with the first communication part; and a control unit configured to control the second communication part. In a process of causing the second communication part to communicate wirelessly with the first communication unit a plurality of times, the control unit detects a change in a response from the first communication part.

The aspect enables proper maintenance of the image formation apparatus by improving accuracy of determining whether a replacement unit is genuine.

BRIEF DESCRIPTION OF THE DRAWINGS

FIG. 6 is a diagram for explaining how a print controller determines whether a replacement unit is genuine.

FIG. 7 is a diagram for explaining a communication test result.

FIG. 8 is a diagram for explaining a communication test result in a modification.

FIG. 12 is a diagram for explaining a communication test result in the second embodiment.

DETAILED DESCRIPTION OF EMBODIMENTS

Figure 1:
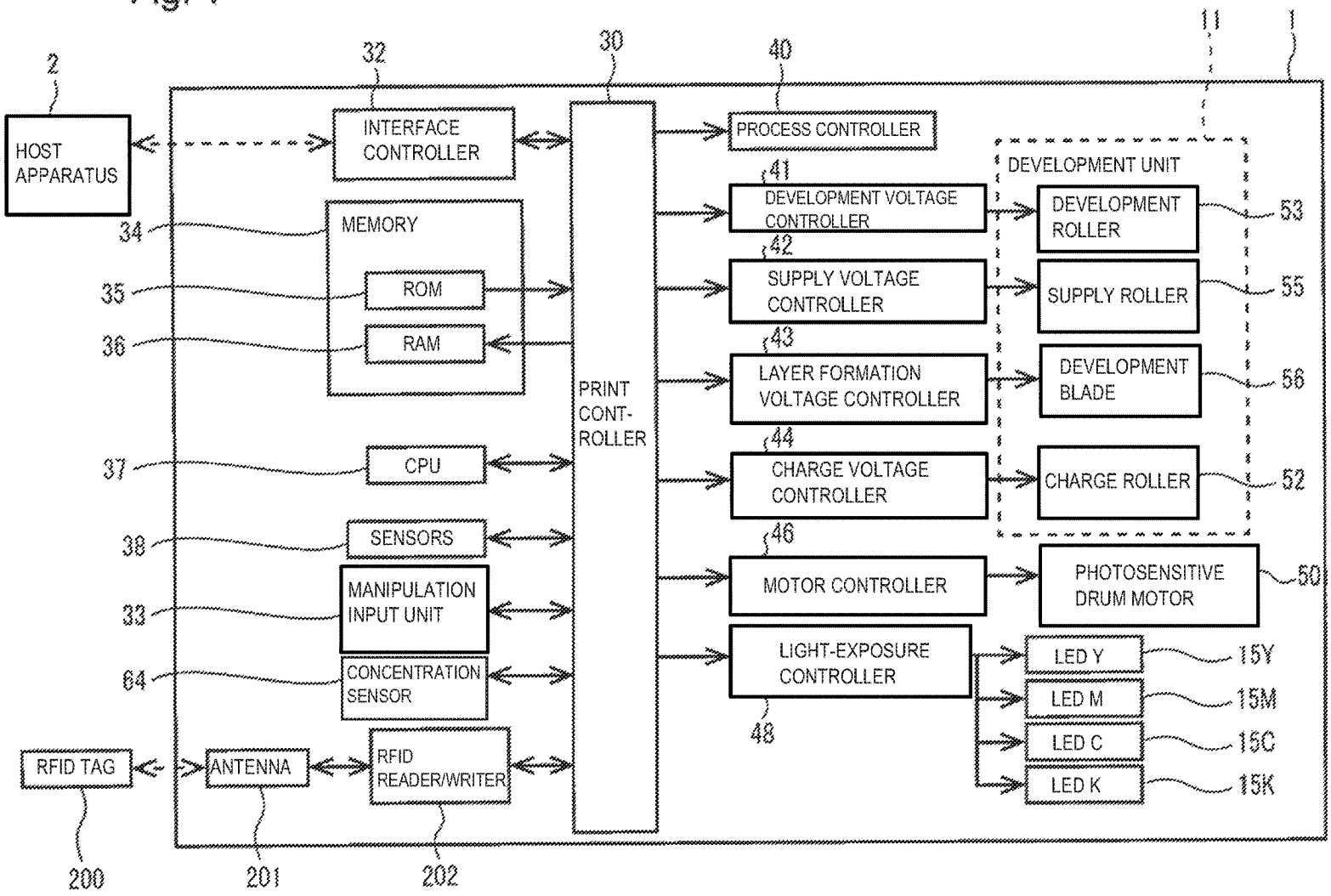
FIG. 1 is a block diagram illustrating a control configuration of an image formation apparatus in a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of an image formation apparatus are hereinbelow described referring to the drawings.

Embodiment 1

Figure 2:
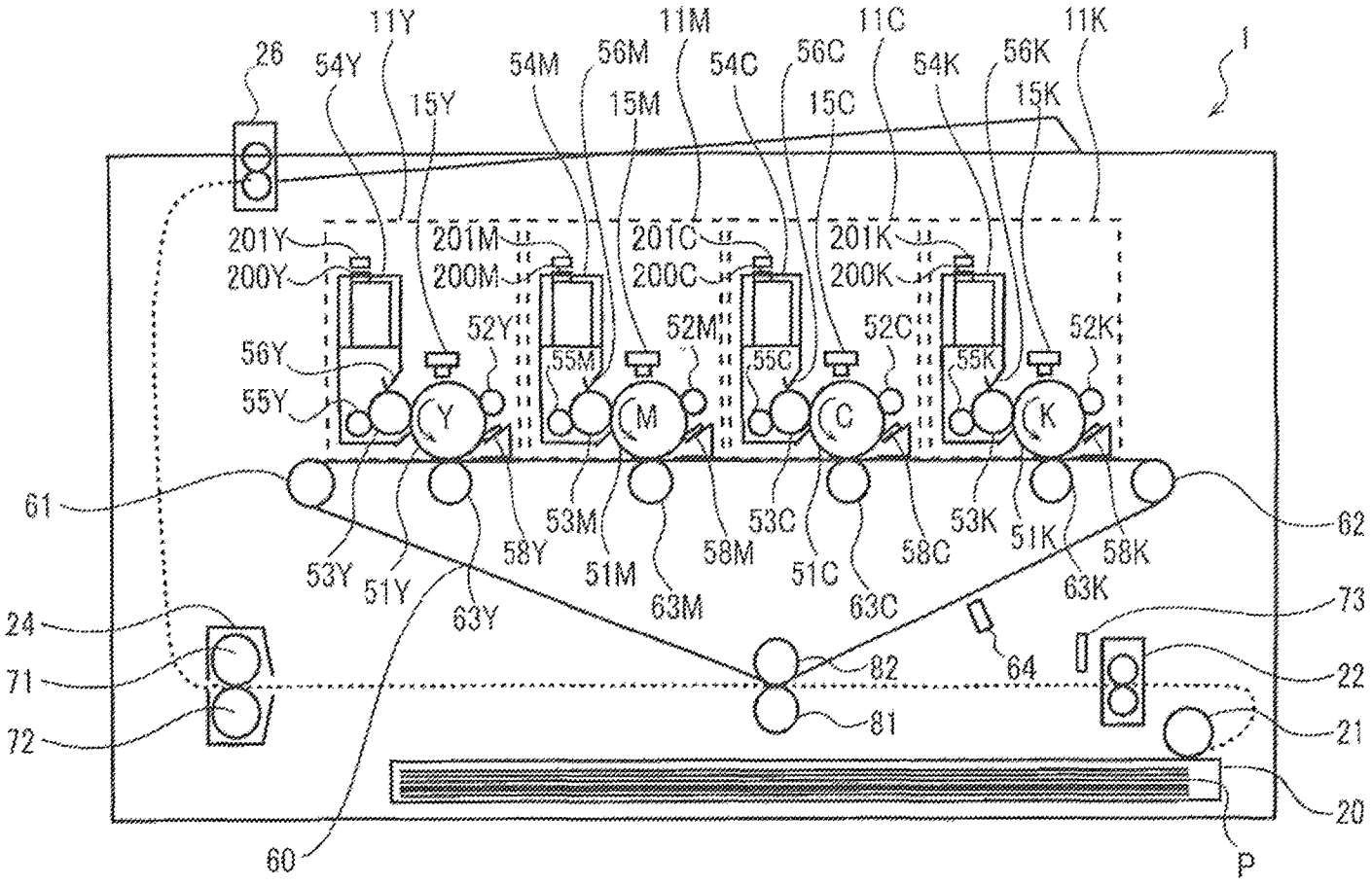
FIG. 2 is a schematic side cross-sectional view illustrating a configuration of the image formation apparatus.

FIG. 2 is a schematic side cross-sectional view illustrating a configuration of an image formation apparatus according to one or more embodiments.

In FIG. 2, image formation apparatus 1 is a printer, a copy machine or the like which is capable of printing using toners as four color developers such as a yellow (Y) developer, a magenta (M) developer, a cyan (C) developer and a black (B) developer, and which replacement units can be detachably attached to. Incidentally, in this embodiment, image formation apparatus 1 is discussed as an intermediate transfer-type printer.

Image formation apparatus 1 includes paper-sheet cassette 20, hopping roller 21, conveyance roller unit 22, paper-sheet position detection sensor 73, development units 11 (11Y, 11M, 11C, 11K), intermediate-transfer belt 60, drive rollers 61, 62, primary transfer rollers 63 (63Y, 63M, 63C, 63K), concentration sensor 64, secondary transfer roller 81, fixation unit 24, delivery roller pair 26, and radio frequency identification (RFID) tags 200 (200Y, 200M, 200C, 200K).

Paper-sheet cassette 20 can be detachably attached to image formation apparatus 1 (a body of image formation apparatus 1), and contains a stack of record media P therein. Hopping roller 21 picks up record media P one at a time while rotating to separate it from record media P contained in paper-sheet cassette 20.

Conveyance roller unit 22 pulls out and coveys each record medium P which is picked up by hopping roller 21. Paper-sheet position detection sensor 73 detects the leading edge of record medium P which is being conveyed by conveyance roller unit 22.

Development units 11 (11Y, 11M, 11C, 11K) respectively include photosensitive drums 51 (51Y, 51M, 51C, 51K), light-emitting diodes (LEDs) 15 (15Y, 15M, 15C, 15K), charge rollers 52 (52Y, 52M, 52C, 52K), development rollers 53 (53Y, 53M, 53C, 53K), toner cartridges 54 (54Y, 54M, 54C, 54K), supply rollers 55 (55Y, 55M, 55C, 55K), development blades 56 (56Y, 56M, 56C, 56K), and cleaning blades 58 (58Y, 58M, 58C, 58K).

Photosensitive drums 51 (51Y, 51M, 51C, 51K) are each an electrostatic latent image carrier configured to carry an electrostatic latent image.

LEDs 15 (15Y, 15M, 15C, 15K) are each a light-exposure member configured to expose the surface of photosensitive drum 51 to light, and thereby to form the electrostatic latent image on the surface of photosensitive drum 51.

Charge rollers 52 (52Y, 52M, 52C, 52K) are each a charge member configured to electrically charge the surface of photosensitive drum 51 uniformly. Development rollers 53 (53Y, 53M, 53C, 53K) are each a developer carrier configured to supply a toner to the electrostatic latent image which is exposed to light and thus formed on the surface of photosensitive drum 51 by LED 15, and thereby to develop the electrostatic latent image.

Toner cartridges 54 (54Y, 54M, 54C, 54K) are each a replacement unit, and a developer container configured to store the toner therein. To put it specifically, image formation apparatus 1 (a body of image formation apparatus 1) includes engagement parts, and toner cartridges 54 (54Y, 54M, 54C, 54K) each as a replacement unit can be detachably attached to the engagement parts, respectively.

Supply rollers 55 (55Y, 55M, 55C, 55K) are each a developer supply member configured to supply the toner to development roller 53 from toner cartridge 54. Development blades 56 (56Y, 56M, 56C, 56K) are each a developer layer control member configured to control the thickness of a toner layer on development roller 53.

Cleaning blades 58 (58Y, 58M, 58C, 58K) are each a cleaner member configured to scrape off the toner remaining on the surface of photosensitive drum 51.

Development units 11 (11Y, 11M, 110, 11K) respectively form the four color toner images in yellow (Y), magenta (M), cyan (C) and black (K) on the surfaces of photosensitive drums 51 (51Y, 51M, 51C, 51K). Incidentally, development units 11Y, 11M, 110, 11K have the same configuration, except that the colors of the toners developed by development units 11Y, 11M, 110, 11K are different from one to another. Detailed descriptions are provided for development units 11Y, 11M, 110, 11K later.

Intermediate-transfer belt 60 is an endless belt. Intermediate-transfer belt 60 is an image carrier placed opposite development units 11 (11Y, 11M, 110, 11K), and configured to convey the toner images transferred onto intermediate-transfer belt 60 from development units 11 (11Y, 11M, 11C, 11K).

Intermediate-transfer belt 60 is stretched between drive rollers 61, 62. Drive rollers 61, 62 rotationally drive intermediate-transfer belt 60. Primary transfer rollers 63 (63Y, 63M, 63C, 63K) are primary transfer members placed opposite photosensitive drums 51 (51Y, 51M, 51C, 51K) with intermediate-transfer belt 60 interposed in between, and configured to transfer the toner images formed on photosensitive drums 51 (51Y, 51M, 51C, 51K) onto intermediate-transfer belt 60.

Concentration sensor 64 is a concentration detector configured to detect the concentration of the toner images transferred onto intermediate-transfer belt 60. Concentration sensor 64 is made from one infrared LED and two light reception photodiodes. The two light reception photodiodes are placed in a way to facilitate their reception of mirror-reflected light and diffused reflected light.

Secondary transfer roller 81 is a secondary transfer member configured to transfer the toner images from intermediate-transfer belt 60 onto record medium P.

Fixation unit 24 is a fixation unit including heater roller 71 and pressure roller 72 which are placed opposite each other, and configured to cause heater roller 71 and pressure roller 72 to heat and press the toner images transferred onto record medium P by secondary transfer roller 81, and thereby to fix the toner images to record medium P. Delivery roller pair 26 conveys record medium P to which fixation unit 24 fixes the toner images, and delivers record medium P to the outside of the apparatus.

RFID tags 200 (200Y, 200M, 200C, 200K) serve as first communication parts (wireless communication parts). RFID tags 200 (200Y, 200M, 200C, 200K) are mounted on toner cartridges 54 (54Y, 54M, 54C, 54K), and are capable of communicating with an RFID reader/writer described later. RFID tags 200 (200Y, 200M, 200C, 200K) each include a memory device configured to store information on toner consumable, for example. The RFID reader/writer described later receives the information stored in RFID tags 200 through its communication with RFID tags 200 via antennas 201 (201Y, 201M, 201C, 201K), and reads the received information.

Although this embodiment discusses the case where toner cartridges 54 are the replacement units, other units such as fixation unit 24 may be categorized into replacement units. When fixation unit 24 and the like are categorized into replacement units, RFID tags 200 are mounted on fixation unit 24 and the like.

FIG. 1 is a block diagram illustrating a control configuration of the image formation apparatus.

As illustrated in FIG. 1, image formation apparatus 1 includes print controller 30, interface controller 32, manipulation input unit 33, memory 34, central processing unit (CPU) 37, sensors 38, concentration sensor 64, process controller 40, development voltage controller 41, supply voltage controller 42, layer formation voltage controller 43, charge voltage controller 44, motor controller 46, light-exposure controller 48 and RFID reader/writer 202.

Interface controller 32 controls communications between image formation apparatus 1 and host apparatus 2. Interface controller 32 receives print data and control commands from host apparatus 2.

As a control unit, print controller 30 controls print operation of image formation apparatus 1 based on the print data and the control commands received via interface controller 32. Furthermore, print controller 30 controls RFID reader/writer 202 to make RFID reader/writer 202 do things such as: reading and writing various sets of information from and to RFID tags 200; and performing a communication test with RFID tags 200.

Manipulation input unit 33 is an operation panel or the like which includes: input devices such as operation buttons to be manipulated by users; and a display device such as a display. Memory 34 is a storage unit including read-only memory (ROM) 35 and random access memory (RAM) 36.

ROM 35 stores control programs (software), control data and the like to be used to control the operation of image formation apparatus 1 as a whole, and to makes image formation apparatus 1 perform the processing. Incidentally, in this example, rewritable flash ROM or the like is used as ROM 35.

RAM 36 temporarily stores various sets of information which is generated during the execution of the control programs. CPU 37 serves as the main control unit. Based on the control programs stored in ROM 35 in memory 34, CPU 37 controls the operation of image formation apparatus 1 as a whole, and makes image formation apparatus 1 perform the processing. Furthermore, CPU 37 includes a time measurement device such as a timer.

Sensors 38 are sensors configured to detect record media. Paper-sheet position detection sensor 73 illustrated in FIG. 2 is among sensors 38.

Concentration sensor 64 is a sensor configured to detect the concentration of the images on intermediate-transfer belt 60 illustrated in FIG. 2. Process controller 40 controls voltages to be applied to the rollers based on a command from print controller 30. Development voltage controller 41 controls voltages (development voltages) to be applied to development rollers 53 in development units 11.

Voltage controller 42 controls voltages (supply voltages) to be applied to supply rollers 55 in development units 11. Layer formation voltage controller 43 controls voltages (layer formation voltages) to be applied to development blades 56 in development units 11. Charge voltage controller 44 controls voltages (charge voltages) to be applied to charge rollers 52 in development units 11.

Motor controller 46 controls photosensitive drum motor 50 to rotationally drive photosensitive drums 51 illustrated in FIG. 2. Gears configured to transmit drives are provided to end portions respectively of photosensitive drums 51, development rollers 53 and supply rollers 55 illustrated in FIG. 2. The gears of development rollers 53 and supply rollers 55 are in mesh with the gears photosensitive drums 51. Thereby, photosensitive drum motor 50 rotationally drives development rollers 53 and supply rollers 55.

Depending on the print data, light-exposure controller 48 controls the light exposure by LEDs 15 (15Y, 15M, 15C, 15K).

RFID reader/writer 202 serves as a second communication part (wireless communication part). Via antennas 201, RFID reader/writer 202 wirelessly communicates with RFID tags 200 mounted on toner cartridges 54. Through the wireless communications, RFID reader/writer 202 does things such as: reading information on consumables stored in RFID tags 200; writing information to RFID tags 200; and performing the communication test with RFID tags 200.

Interface controller 32, manipulation input unit 33, memory 34, CPU 37, sensors 38, concentration sensor 64 and RFID reader/writer 202 output signals to print controller 30 to which they are connected. Meanwhile, process controller 40, development voltage controller 41, supply voltage controller 42, layer formation voltage controller 43, charge voltage controller 44, motor controller 46 and light-exposure controller 48 receive output signals from print controller 30 to which they are connected, and operate based on the signals.

In the process where RFID reader/writer 202 communicates wirelessly with RFID tag 200 several times, print controller 30 determines whether RFID tag 200 is genuine based on a change in the response from RFID tag 200. Thereby, print controller 30 determines whether the replacement unit on which RFID tag 200 is mounted is genuine.

Figure 3:
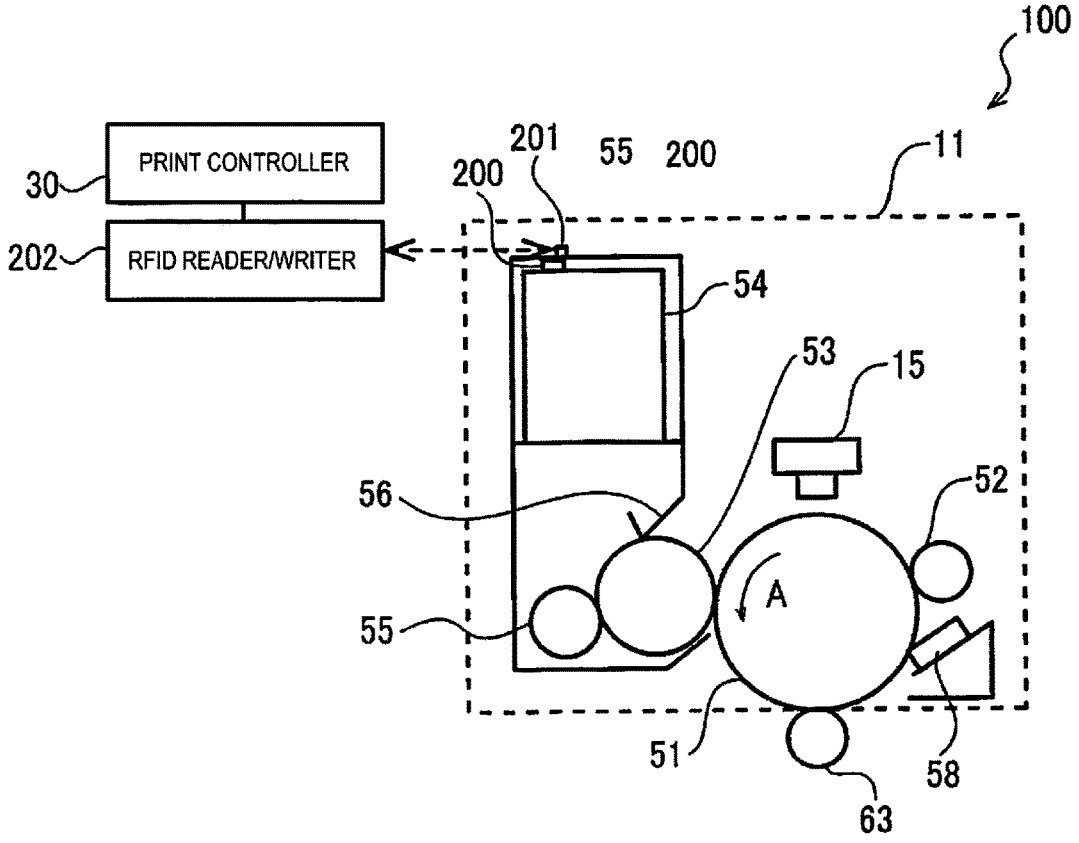
FIG. 3 is an explanatory diagram illustrating a configuration of an image formation section in the image formation apparatus.

FIG. 3 is an explanatory diagram illustrating a configuration of an image formation section in the image formation apparatus.

As illustrated in FIG. 3, image formation section 100 includes development unit 11, print controller 30 and RFID reader/writer 202.

Development unit 11 includes photosensitive drum 51, LED 15, charge roller 52, development roller 53, toner cartridge 54, supply roller 55, development blade 56, cleaning blade 58, RFID tag 200 and antenna 201.

As the electrostatic latent image carrier configured to carry the electrostatic latent image, photosensitive drum 51 generates the electrostatic latent image on its surface. Photosensitive drum 51 rotates in a direction indicated with an arrow A in FIG. 3 due to the drive of photosensitive drum motor 50 illustrated in FIG. 1.

Under the control of charge voltage controller 44 illustrated in FIG. 1, a predetermined voltage is applied to charge roller 52 as the charge member. Thereby, charge roller 52 electrically charges the surface of photosensitive drum 51 uniformly.

LED 15 is placed opposite the surface of photosensitive drum 51. Based on the print data, LED 15 exposes the surface of photosensitive drum 51 to light by selectively emitting the light onto the surface of photosensitive drum 51, and forms the electrostatic latent image on the surface of photosensitive drum 51.

Toner cartridge 54 stores the toner as the developer. The toner is used to render a visible image on the record medium. Used as the toner of this embodiment is a powder developer with an average particle diameter of 8 μm made by a grinding method from a polyester resin, colorants, a charge control agent and a release agent, as well as an external additive (hydrophobic silica).

Under the control of development voltage controller 41, a predetermined voltage is applied to development roller 53. Thereby, development roller 53 develops the toner on the electrostatic latent image formed on photosensitive drum 51. Development roller 53 is made by covering a metal-made shaft with an elastic member, for example by covering a metal-made shaft with a semi-conductive urethane rubber with a rubber hardness of 70 degrees (in the Asker C hardness scale) as the elastic member.

Supply roller 55 supplies the toner to development roller 53 from toner cartridge 54 which contains it.

Development blade 56 controls the toner layer on development roller 53 to make the toner layer have a certain thickness.

Cleaning blade 58 removes toner which remains on the surface of photosensitive drum 51 because of not being transferred onto the record medium. RFID tag 200 storing information on the consumable is mounted on toner cartridge 54.

Toner cartridge 54 can be drawn out from development unit 11 to be replaced with a new one, when toner cartridge 54 runs out of toner.

Under the control of print controller 30, RFID reader/writer 202 communicates wirelessly with RFID tag 200 mounted on toner cartridge 54 via antenna 201. Thereby, RFID reader/writer 202 does things such as: reading information on the consumable stored in RFID tag 200; writing information to RFID tag 200; and performing the communication test with RFID tag 200.

Figure 4:
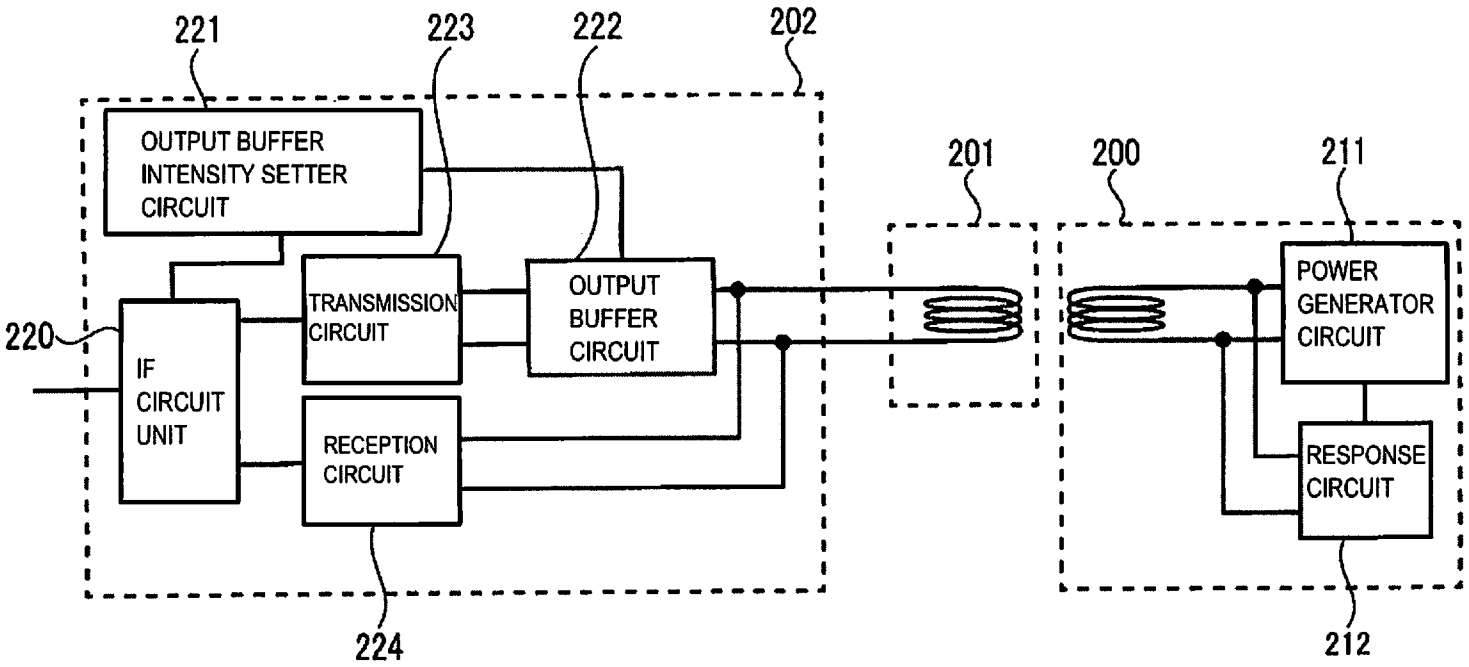
FIG. 4 is a block diagram illustrating an RFID configuration of the image formation apparatus.

FIG. 4 is a block diagram illustrating an RFID configuration.

In FIG. 4, RFID reader/writer 202 communicates wirelessly and contactlessly with RFID tag 200 via antenna 201. As illustrated in FIG. 3, RFID reader/writer 202 does things such as: reading information on the consumable which is stored in RFID tag 200 mounted on toner cartridge 54 together with antenna 201; writing information to RFID tag 200; and performing the communication test with RFID tag 200.

RFID reader/writer 202 includes IF circuit unit 220, output buffer intensity setter circuit 221, output buffer circuit 222, transmission circuit 223 and reception circuit 224.

IF circuit unit 220 in RFID reader/writer 202 communicates with print controller 30 illustrated in FIG. 1; controls output buffer intensity setter circuit 221, transmission circuit 223 and reception circuit 224; and communicates with RFID tag 200.

Output buffer intensity setter circuit 221 sets the output buffer intensity. Print controller 30, illustrated in FIG. 1, sets the value for the output buffer intensity set by output buffer intensity setter circuit 221.

Output buffer circuit 222 serves as a power supply unit. Under the control of output buffer intensity setter circuit 221, based on the value set for the output buffer intensity set by output buffer intensity setter circuit 221, output buffer circuit 222 controls the output of a radio wave as a communication signal, and controls the intensity of the electric power to be supplied to RFID tag 200 (or electric power consumed by RFID tag 200).

In this respect, the output buffer intensity means the intensity of the radio wave which output buffer circuit 222 generates in order to change the intensity of the electric power generated by RFID tag 200. For example, in order to increase the electric power generated by RFID tag 200, output buffer circuit 222 increases the amplitude of the radio wave to be transmitted. Meanwhile, in order to decrease the electric power generated by RFID tag 200, output buffer circuit 222 decreases the amplitude of the radio wave to be transmitted to RFID tag 200.

RFID tag 200 includes power generator circuit 211 and response circuit 212. Power generator circuit 211 generates electric power from the communication signal which power generator circuit 211 receives from RFID reader/writer 202.

Response circuit 212 responds to the communication signal received from RFID reader/writer 202. For example, response circuit 212 stores various sets of information, inclusive of the information on the consumable. Furthermore, response circuit 212 responds to the communication signal from RFID reader/writer 202 by sending the information on the consumable, and responds to an authentication instruction from RFID reader/writer 202 by sending the authentication information. Response circuit 212 operates based on the electric power supplied from power generator circuit 211.

Descriptions are provided for how the above-discussed configuration works.

To begin with, the outline of the print operation of the image formation apparatus is described based on FIGS. 2 and 3.

Conveyance roller unit 22 conveys record medium P, supplied from paper-sheet cassette 20, to secondary transfer roller 81.

Meanwhile, after the toner is supplied to the inside of development unit 11 from toner cartridge 54, supply roller 55 supplies the toner to development roller 53 which is rotating. After the toner is supplied to rotating development roller 53, development blade 56 controls the toner to make the toner layer have a certain thickness. Thereafter, development roller 53 conveys the resultant toner onto the electrostatic latent image formed on photosensitive drum 51. Photosensitive drum 51 develops the electrostatic latent image as the toner image. Primary transfer roller 63 electrically transfers the developed toner onto intermediate-transfer belt 60.

After development unit 11 forms the toner image on intermediate-transfer belt 60, secondary transfer roller 81 transfers the toner image onto record medium P which is conveyed to secondary transfer roller 81.

After the toner image is transferred onto record medium P, record medium P is conveyed to fixation unit 24. Fixation unit 24 fixes the toner image to record medium P with the heat and pressure. Delivery roller pair 26 delivers record medium P to the outside of the apparatus.

Figure 5:
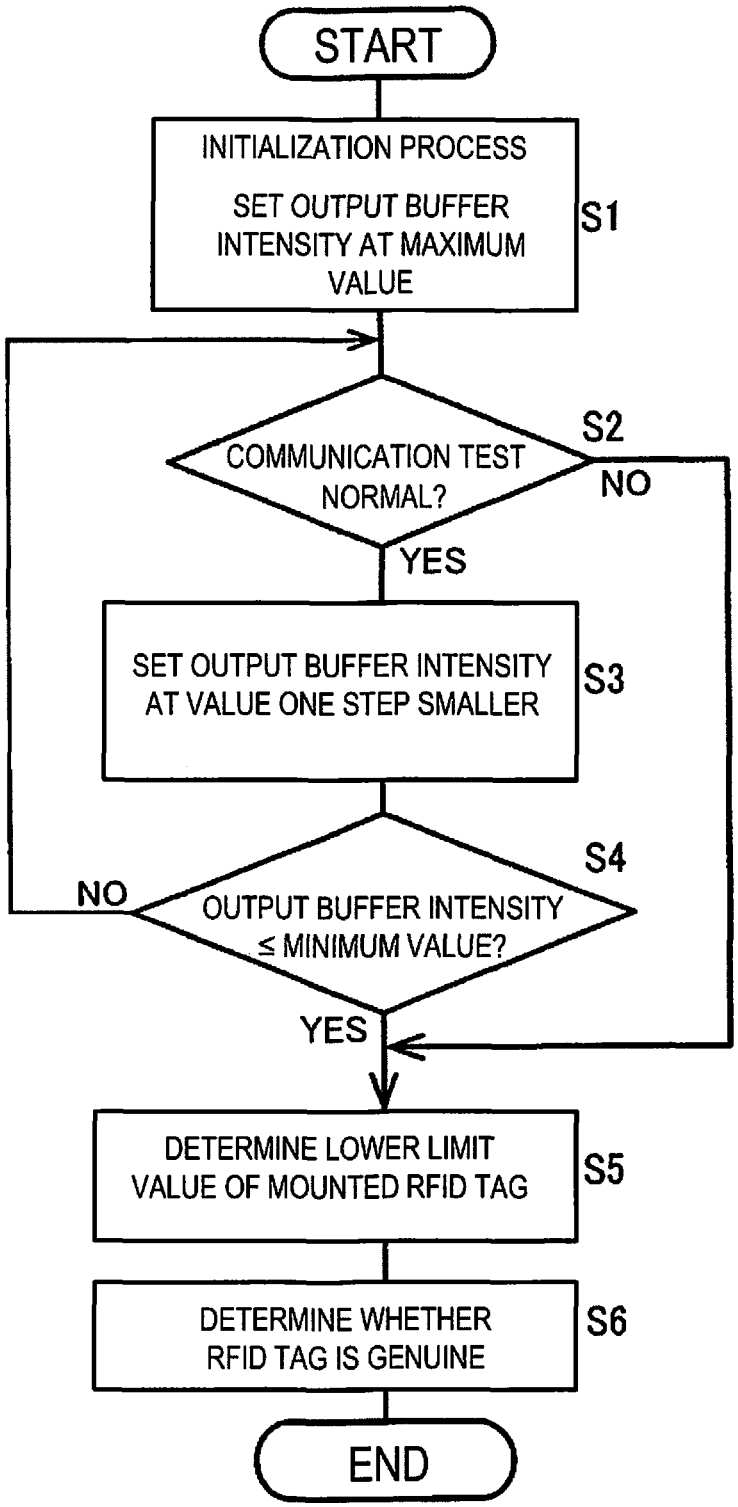
FIG. 5 is a flowchart illustrating a flow of a communication test process which the image formation apparatus performs.

Next, by following steps whose reference signs start with the letter S in a flowchart illustrating a flow of a communication test process in FIG. 5, descriptions are provided for how the print controller of the image formation apparatus performs the communication test process with the RFID tag, by referring to FIGS. 1, 3 and 4.

In this communication test process, the print controller performs the communication test with the output buffer intensity of FID reader/writer 202 decreased in steps. The print controller determines whether the RFID tag is genuine by identifying differences between electric powers which RFID tag needs to perform the communication operation. Thereby, the print controller determines whether the toner cartridge on which the RFID tag is mounted is genuine.

Furthermore, the print controller performs the communication test process each time FID reader/writer 202 communicates with the RFID tag. For example, the print controller performs the communication test process at times such as: when a user powers on the image formation apparatus; when a user opens the cover of the image formation apparatus in order to replace the toner cartridge with a new one; when FID reader/writer 202 writes information on the state of the consumable to the RFID tag after the image formation apparatus finishes performing the print operation based on the print data.

Step S1: Print controller 30 of image formation apparatus 1 initializes the value for the output buffer intensity, which is set by output buffer intensity setter circuit 221 of RFID reader/writer 202, at a maximum value.

Step S2: Print controller 30 sends test data from IF circuit unit 220, transmission circuit 223 and output buffer circuit 222 based on the setting of the output buffer intensity by output buffer intensity setter circuit 221; and receives the response from RFID tag 200 using reception circuit 224. If print controller 30 determines that the response from RFID tag 200 is normally received within a predetermined length of time, i.e., the response is normal, print controller 30 proceeds to step S3. On the other hand, if print controller 30 determines that no response is received from RFID tag 200 within the predetermined length of time, or that the received response from RFID tag 200 within the predetermined length of time is abnormal, i.e., that the response is not received or is abnormal, print controller 301 proceeds to step S5.

In this respect, the test data used in this embodiment is authentication data (authentication instruction) which requires RFID tag 200 to consume larger electric power. Examples of this authentication data include: data including authentication information such as ID data and a password; and data requiring the authentication data from RFID tag 200.

If reception circuit 224 fails to receive the response from RFID tag 200 within the predetermined length of time, print controller 30 changes the value set for the output buffer intensity, which is set by output buffer intensity setter circuit 221, to a boundary value which is a step smaller than the lower limit value of the output buffer intensity which makes RFID tag 200 mounted on toner cartridge 54 operable. Here, if reception circuit 224 receives no response from RFID tag 200 at all, print controller 30 resets the initial value at the boundary value.

Step S3: If print controller 30 determines that reception circuit 224 receives the response from RFID tag 200 within the predetermined length of time, print controller 30 changes the value set for the output buffer intensity, which is set by output buffer intensity setter circuit 221 of RFID reader/writer 202, to a value a step smaller than the current value.

Step S4: Print controller 30 determines whether the value set for the output buffer intensity, which is set by output buffer intensity setter circuit 221 of RFID reader/writer 202, is less than a minimum value. If print controller 30 determines that the set value is less than the minimum value, print controller 30 proceeds to step S5. If print controller 30 determines that the set value is equal to or greater than the minimum value, print controller 30 proceeds to step S2 to transmit the test data.

Step S5: Print controller 30 decides to use the value set for the output buffer intensity, which is set by output buffer intensity setter circuit 221 of RFID reader/writer 202, as the boundary value which is a step smaller than the lower limit value of the output buffer intensity which makes RFID tag 200 mounted on toner cartridge 54 operable.

Step S6: From the determined boundary value, print controller 30 derives the lower limit value of the output buffer intensity which makes RFID tag 200 mounted on toner cartridge 54 operable. Thereafter, based on the derived lower limit value and a genuineness determination threshold value, print controller 30 determines whether RFID tag 200 is genuine. With this determination, print controller 30 terminates the process.

It should be noted that if print controller 30 determines that RFID tag 200 is not genuine based on the result of determining whether RFID tag 200 is genuine, print controller 30 displays, on the screen of the display device of manipulation input unit 33, a massage that the toner cartridge on which non-genuine RFID tag 200 is mounted is attached to the image formation apparatus.

If non-genuine toner cartridge 54 is attached to image formation apparatus 1, there is likelihood that image formation apparatus 1 needs maintaining because properties (for example, the melting temperature for fixation) of the toner filled in non-genuine toner cartridge 54 are different from properties of the toner filled in genuine toner cartridge 54.

In this case, a person in charge of the maintenance of image formation apparatus 1 can receive the message that non-genuine toner cartridge 54 is attached to image formation apparatus 1, and thereby conduct proper maintenance of image formation apparatus 1 promptly.

Next, based on a diagram for explaining the genuineness determination in FIG. 6, descriptions are provided for how the print controller determines whether RFID tag 200 is genuine, by referring to FIGS. 1, 3 and 4.

When print controller 30 decreases the output buffer intensity by decreasing the value set in output buffer intensity setter circuit 221 of RFID reader/writer 202, the electric power generated by power generator circuit 211 inside RFID tag 200 becomes smaller.

Print controller 30 is capable of determining the lower limit of the electric power which RFID tag 200 needs for its operation by performing the communication test with the output buffer intensity of RFID reader/writer 202 decreased in steps.

To put it specifically, in the process where print controller 30 gradually changes the power amount supplied by output buffer circuit 222 to a smaller amount, print controller 30 detects that the response from RFID tag 200 changes from a normal response to an abnormal response or no response, and thereby determines the lower limit of the electric power which RFID tag 200 needs for its operation.

In an example illustrated in FIG. 6, the maximum and minimum values of the value set in output buffer intensity setter circuit 221 of RFID reader/writer 202 are respectively at 10 and 1; for genuine RFID tag 200, the set value corresponding to its normal operation is in a range of 10 to 5; and therefore, the set value equal to or less than 4 indicates the abnormal operation, i.e., no response and an abnormal communication. In this case, the genuineness determination threshold value is 5.

In this respect, the normal operation of RFID tag 200 means that RFID tag 200 responds correctly within the predetermined length of time to the test data transmitted from RFID reader/writer 202. The abnormal operation of RFID tag 200 means: no response from RFID tag 200 (i.e., RFID tag 200 does not respond within the predetermined length of time to the test data transmitted from RFID reader/writer 202; and the abnormal communication from RFID tag 200 (i.e., RFID tag 200 communicates abnormally although RFID tag 200 responds within the predetermined length of time to the test data transmitted from RFID reader/writer 202, e.g., RFID tag 200 fails in the authentication).

A communication test result in FIG. 7 illustrates how the print controller discriminates a non-genuine RFID tag from genuine RFID tag 200. For genuine RFID tag 200, the set value for the buffer intensity corresponding to its normal operation is in a range of 10 to 5; and the genuineness determination threshold value is at 5. If, for example, currently-mounted RFID tag 200 normally operates only within a range of 10 to 7, the lower limit value derived through the communication test is at 7, which is greater than the genuineness determination threshold value. This means that the power amount which RFID tag 200 in question needs to consume for its operation is larger than the power amount which genuine RFID tag 200 needs to consume for its operation. For this reason, the printer controller is capable of determining that the circuit configuration of RFID tag 200 in question is different from that of genuine RFID tag 200.

As described above, print controller 30 is configured: to perform the communication test with the output buffer intensity of RFID reader/writer 202 decreased in steps; and to, from the determined boundary value, derive the lower limit value of the output buffer intensity which makes RFID tag 200 operable. For this reason, print controller 30 is capable of: identifying the difference between genuine RFID tag 200 and non-genuine RFID tag 200 in terms of the electric power needed for their operation; and determining whether RFID tag 200 is genuine.

To put it specifically, if the lower limit value of RFID tag 200 derived through the communication test is greater than the lower limit value (genuineness determination threshold value) which makes genuine RFID tag 200 operable, print controller 30 is capable of determining that toner cartridge 54 on which RFID tag 200 in question is mounted is not genuine. Meanwhile, if the lower limit value of RFID tag 200 derived through the communication test is equal to the lower limit value (genuineness determination threshold value) which makes genuine RFID tag 200 operable, print controller 30 is capable of determining that toner cartridge 54 on which RFID tag 200 in question is mounted is genuine.

In other words, if the power amount supplied by output buffer circuit 222 of RFID reader/writer 202 is larger than the predetermined power amount (the lower limit value of the value set for the buffer intensity which makes genuine RFID tag 200 normally operable), if printer controller 30 detects a change in the response from RFID tag 200, printer controller 30 determines that RFID tag 200 is not genuine.

Furthermore, as a modification, the configuration may be such that if the lower limit value of RFID tag 200 derived through the communication test is less than the lower limit value (genuineness determination threshold value) which makes genuine RFID tag 200 operable, print controller 30 determines that toner cartridge 54 on which RFID tag 200 in question is mounted is not genuine.

For example, a communication test result in FIG. 8 illustrates how the print controller discriminates a non-genuine RFID tag from genuine RFID tag 200. For genuine RFID tag 200, the set value for the buffer intensity corresponding to its normal operation is in a range of 10 to 5; and the genuineness determination threshold value is at 5. If, for example, currently-mounted RFID tag 200 normally operates within a range of 10 to 3, the lower limit value derived through the communication test is at 3, which is less than the genuineness determination threshold value. This means that the power amount which RFID tag 200 in question needs to consume for its operation is smaller than the power amount which genuine RFID tag 200 needs to consume for its operation, or that an energy source such as a battery is installed in RFID tag 200 in question. For this reason, the printer controller is capable of determining that the circuit configuration of RFID tag 200 in question is different from that of genuine RFID tag 200.

To put it specifically, if the lower limit value of RFID tag 200 derived through the communication test is less than the lower limit value (genuineness determination threshold value) which makes genuine RFID tag 200 operable, print controller 30 is capable of determining that toner cartridge 54 on which RFID tag 200 in question is mounted is not genuine. Meanwhile, if the lower limit value of RFID tag 200 derived through the communication test is equal to the lower limit value (genuineness determination threshold value) which makes genuine RFID tag 200 operable, print controller 30 is capable of determining that toner cartridge 54 on which RFID tag 200 in question is mounted is genuine.

In other words, if the power amount supplied by output buffer circuit 222 of RFID reader/writer 202 is smaller than the predetermined power amount (the lower limit value of the value set for the buffer intensity which makes genuine RFID tag 200 normally operable), if printer controller 30 detects a change in the response from RFID tag 200, printer controller 30 determines that RFID tag 200 is not genuine.

Furthermore, as another modification, the configuration may be such that if the lower limit value of RFID tag 200 derived through the communication test does not coincide with the lower limit value (genuineness determination threshold value) which makes genuine RFID tag 200 operable, print controller 30 determines that toner cartridge 54 on which RFID tag 200 in question is mounted is not genuine.

For example, the communication test results in FIGS. 7 and 8 illustrate how the print controller discriminates a non-genuine RFID tag from genuine RFID tag 200. For genuine RFID tag 200, the set value for the buffer intensity corresponding to its normal operation is in a range of 10 to 5; and the genuineness determination threshold value is at 5. If, for example, currently-mounted RFID tag 200 normally operates within a range of 0 to 7 (or 3), the lower limit value derived through the communication test is at 7 (or 3), which is greater (or less) than the genuineness determination threshold value. This means that the power amount which RFID tag 200 in question needs to consume for its operation is larger (or smaller) than the power amount which genuine RFID tag 200 needs to consume for its operation. For this reason, the printer controller is capable of determining that the circuit configuration of RFID tag 200 in question is different from that of genuine RFID tag 200.

To put it specifically, if the lower limit value of RFID tag 200 derived through the communication test does not coincide with, or is not equal to, the lower limit value (genuineness determination threshold value) which makes genuine RFID tag 200 operable, print controller 30 is capable of determining that toner cartridge 54 on which RFID tag 200 in question is mounted is not genuine. Meanwhile, if the lower limit value of RFID tag 200 derived through the communication test coincides with the lower limit value (genuineness determination threshold value) which makes genuine RFID tag 200 operable, print controller 30 is capable of determining that toner cartridge 54 on which RFID tag 200 in question is mounted is genuine.

As described above, print controller 30 of this embodiment controls the RFID reader/writer 202 to change the value set in output buffer intensity setter circuit 221, and thereby to gradually (in phased manner) change the power amount supplied from output buffer circuit 222. Thus, based on the change in the response from RFID tag 200 in response to the gradual change in the power amount, print controller 30 determines whether RFID tag 200 is genuine.

As described above, the first embodiment is configured such that the print controller performs the communication test with the output buffer intensity of the RFID reader/writer decreased in steps, and thereby derives the lower limit value of the output buffer intensity which makes the RFID tag operable. For this reason, it is possible to obtain the effect of being capable of: identifying the difference between the genuine RFID tag and the non-genuine RFID tag in terms of the electric power needed for their operation; and thereby determining whether the RFID tag in question is genuine.

Accordingly, it is possible to obtain the effect of enabling proper maintenance of the image formation apparatus by improving accuracy of determining whether the replacement unit on which the RFID tag in question is mounted is genuine.

Embodiment 2

The configuration of the image formation apparatus of the second embodiment is different from that of the image formation apparatus of the first embodiment in terms of their control configurations. Incidentally, components of the second embodiment which are the same as those of the first embodiment are denoted by the same reference signs.

Figure 9:
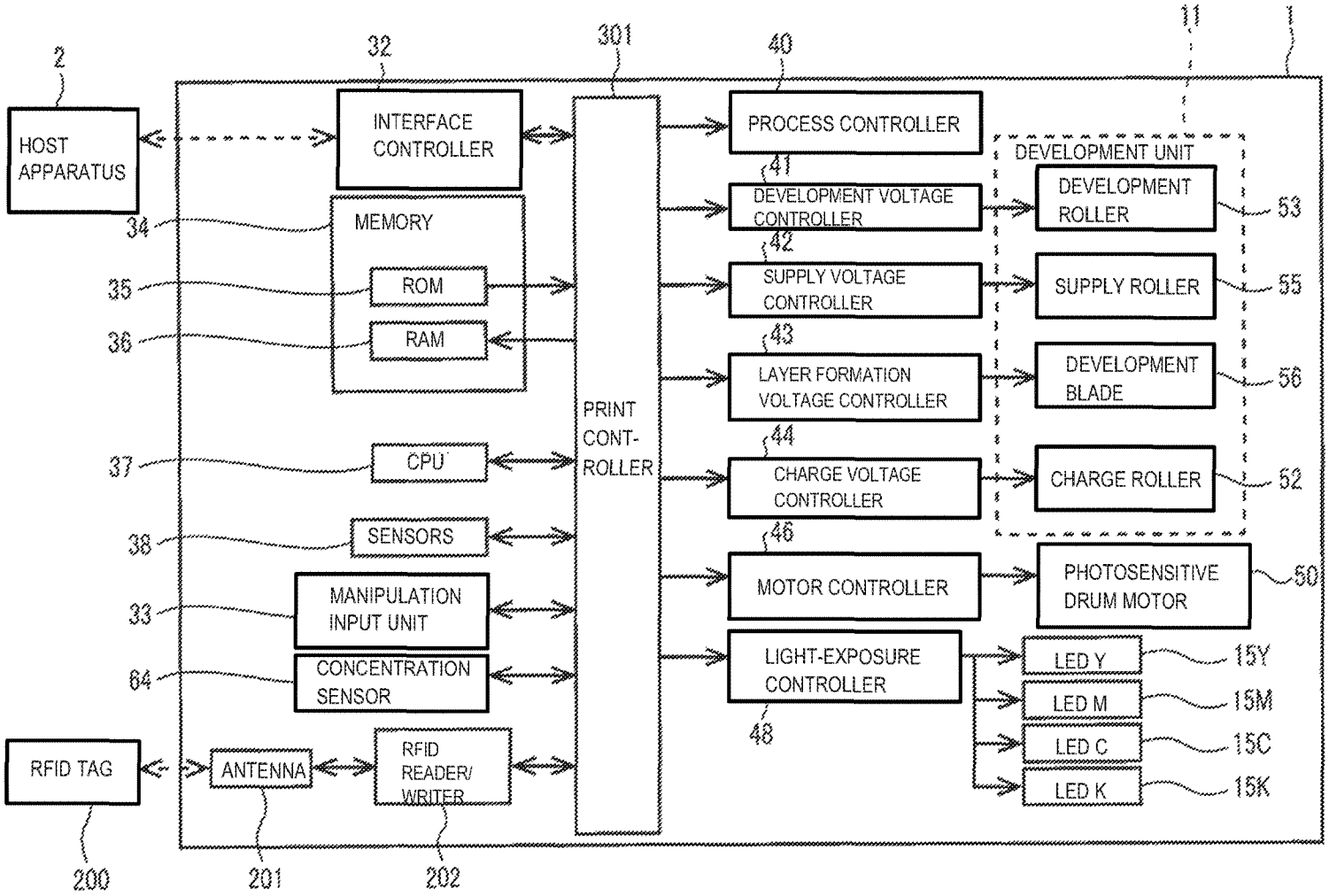
FIG. 9 is a block diagram illustrating a control configuration of an image formation apparatus in a second embodiment.

FIG. 9 is a block diagram illustrating the control configuration of the image formation apparatus of the second embodiment.

As illustrated in FIG. 9, image formation apparatus 1 includes print controller 301, interface controller 32, manipulation input unit 33, memory 34, CPU 37, sensors 38, concentration sensor 64, process controller 40, development voltage controller 41, supply voltage controller 42, layer formation voltage controller 43, charge voltage controller 44, motor controller 46, light-exposure controller 48 and RFID reader/writer 202.

As a control unit, print controller 301 controls print operation of image formation apparatus 1 based on the print data and the control commands received via interface controller 32. Furthermore, print controller 301 controls RFID reader/writer 202 to make RFID reader/writer 202 perform a communication test with RFID tags 200.

Figure 10:
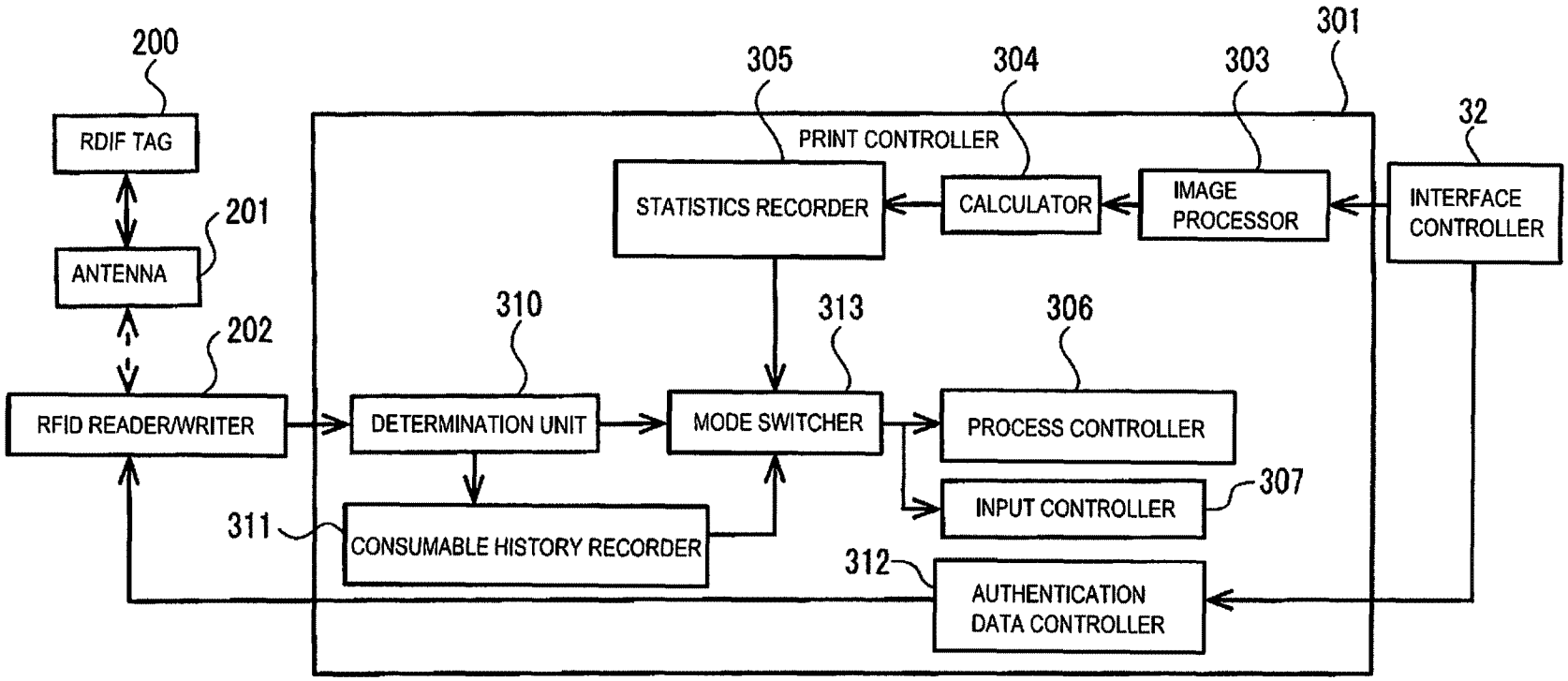
FIG. 10 is a block diagram illustrating a configuration of a print controller in the second embodiment.

FIG. 10 is a block diagram illustrating the configuration of the print controller. As illustrated in FIG. 10, print controller 301 includes image processor 303, calculator 304, statistics recorder 305, process controller 306, input controller 307, determination unit 310, consumable history recorder 311, authentication data controller 312 and mode switcher 313.

Image processor 303 analyzes the print data received via interface controller 32.

Based on the print data analyzed by image processor 303, calculator 304 calculates toner consumption amounts. Statistics recorder 305 stores the cumulative total of the toner consumption amounts calculated by calculator 304 into memory 34 illustrated in FIG. 9. The cumulative total serves as statistical information.

Based on the print data received from image processor 303, process controller 306 performs the image formation process for forming an image on a record medium. Based on the input information inputted from manipulation input unit 33 illustrated in FIG. 9, input controller 307 displays various sets of information on the display screen.

Based on information read by RFID reader/writer 202 from RFID tag 200, determination unit 310 determines whether toner cartridge 54 attached to development unit 11 illustrated in FIG. 3 is genuine.

Determination unit 310 further determines whether RFID reader/writer 202 can access RFID tag 200.

Consumable history recorder 311 stores information on the history of replacement of toner cartridge 54 as a consumable illustrated in FIG. 3. Consumable history recorder 311 further stores a result of the determination by determination unit 310.

After interface controller 32 receives the print data, each time a predetermined length of time elapses, authentication data controller 312 causes RFID reader/writer 202 to send RFID tag 200 authentication data which is stored in RFID reader/writer 202, and which requires RFID tag 200 to consume large electric power. Incidentally, in this embodiment, RFID reader/writer 202 is set at a predetermined output buffer intensity.

Mode switcher 313 switches modes of the screen which input controller 307 displays on manipulation input unit 33 illustrated in FIG. 9, depending on results of the determination by determination unit 310. In this respect, the results of the determination thereby are threefold: genuine, not genuine, and inaccessible.

After RFID reader/writer 202 starts to transmit information to RFID tag 200, print controller 301 of this embodiment performs change detection in the response from RFID tag 200 at predetermined time intervals, and thereby determines whether RFID tag 200 is genuine.

Descriptions are provided for how the above-discussed configuration works.

Incidentally, the image formation apparatus performs the same print operation as the image formation apparatus of the first embodiment. For this reason, descriptions for the print operation of the image formation apparatus are omitted.

Figure 11:
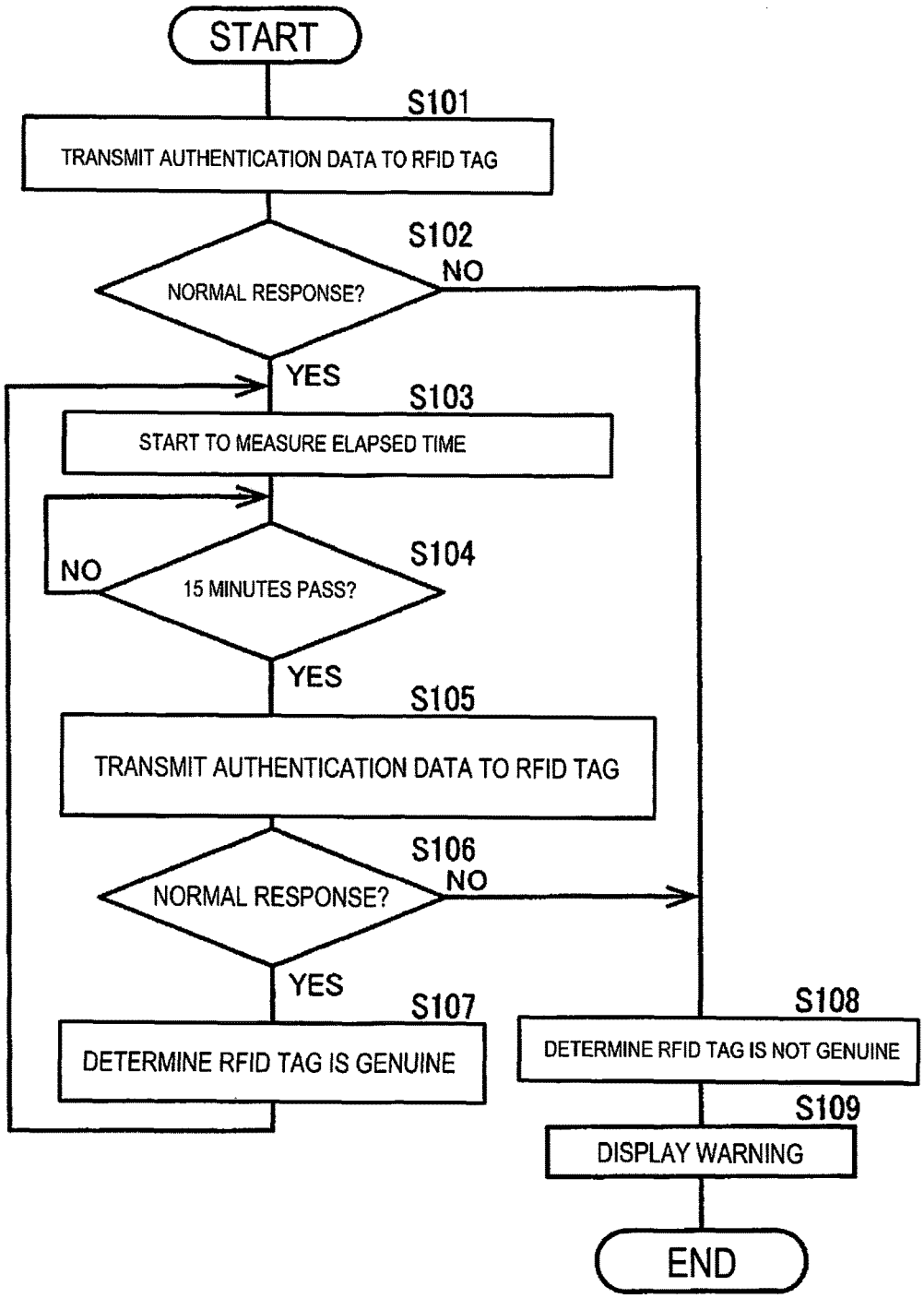
FIG. 11 is a flowchart illustrating a flow of a communication test process in the second embodiment.

By following steps whose reference signs start with the letter S in a flowchart illustrating a flow of a communication test process of the second embodiment in FIG. 11, descriptions are provided for how the print controller of the image formation apparatus performs the communication test process with the RFID tag, by referring to FIGS. 9 and 10.

In this communication test process, at the predetermined time intervals, the print controller causes RFID reader/write 202 to transmit the authentication data to RFID tag 200, and determines whether the RFID tag responds to the transmitted authentication data. Thereby, the print controller determines whether the RFID tag is genuine, and thus determines whether the toner cartridge on which the RFID tag is mounted is genuine.

Furthermore, the print controller performs the communication test process each time FID reader/writer 202 communicates with the RFID tag. For example, the print controller performs the communication test process at times such as: when a user powers on the image formation apparatus; when a user opens the cover of the image formation apparatus in order to replace the toner cartridge with a new one; and when FID reader/writer 202 writes information on the state of the consumable to the RFID tag after the image formation apparatus finishes performing the print operation based on the print data.

Step S101: Print controller 301 of image formation apparatus 1 switches the screen mode to an RFID authentication mode, and authentication data controller 312 controls RFID reader/writer 202 to make RFID reader/writer 202 transmit the authentication data as the test data to RFID tag 200.

Step S102: Determination unit 310 of print controller 301 receives the response from RFID tag 200 using RFID reader/writer 202. If determination unit 310 determines that the response from RFID tag 200 is normally received within the predetermined length of time, i.e., the response is normal, print controller 301 proceeds to step S103. On the other hand, if determination unit 310 determines that no response is received from RFID tag 200 within the predetermined length of time, or that the received response from RFID tag 200 within the predetermined length of time is abnormal, i.e., that the response is not received or is abnormal, print controller 301 proceeds to step S108.

Step S103: Once determination unit 310 determines that the response from RFID tag 200 is normal, print controller 301 starts to measure the length of time which elapses after the reception of the normal response using the time measurement device.

Step S104: Print controller 301 monitors whether as a predetermined length of time, 15 minutes elapses after the reception of the normal response. If print controller 301 determines that the predetermined length of time elapses, print controller 301 proceeds to step S105.

Step S105: After print controller 301 determines that the predetermined length of time elapses, authentication data controller 312 of print controller 301 controls RFID reader/writer 202 to make RFID reader/writer 202 transmit the authentication data as the test data to RFID tag 200.

Step S106: Determination unit 310 of print controller 301 receives the response from RFID tag 200 using RFID reader/writer 202. If determination unit 310 of print controller 301 determines the response from RFID tag 200 is normally received within the predetermined length of time, i.e., the response is normal, print controller 301 proceeds to step S107. On the other hand, if determination unit 310 determines that no response is received from RFID tag 200 within the predetermined length of time, or the received response from RFID tag 200 within the predetermined length of time is abnormal, i.e., that the response is not received or is abnormal, print controller 301 proceeds to step S108.

Step S107: Once determination unit 310 of print controller 301 determines that the response from RFID tag 200 is normal, determination unit 310 of print controller 301 stores information that RFID tag 200 is genuine into consumable history recorder 311, and causes mode switcher 313 to set a mode for displaying a normal print screen on the display device of manipulation input unit 33. Print controller 301 proceeds to step S103.

Step S108: On the other hand, if in step S102 of S106 determination unit 310 of print controller 301 determines that no response is received from RFID tag 200 within the predetermined length of time, or that the received response from RFID tag 200 within the predetermined length of time is abnormal, determination unit 310 of print controller 301 stores information that RFID tag 200 is not genuine into consumable history recorder 311, and causes mode switcher 313 to set a mode for displaying a warning screen on the display device of manipulation input unit 33.

Once, as discussed above, determination unit 310 of print controller 301 detects the change in the response from RFID tag 200, i.e., detects that the response from RFID tag 200 changes from the normal response to the abnormal response or no response, determination unit 310 of print controller 301 determines that RFID tag 200 is not genuine.

Step S109: Input controller 307 of print controller 301 displays, on the screen of the display device of manipulation input unit 33, a warning massage that the toner cartridge on which non-genuine RFID tag 200 is mounted is attached to the image formation apparatus.

A Communication test result in FIG. 12 illustrates how print controller 301 eventually determines that RFID tag 200 in question is not genuine. For 105 minutes after in step S103, print controller 301 starts to measure the elapsed time, the responses from RFID tag 200 are normal, and therefore print controller 301 determines that that RFID tag 200 is genuine. After the lapse of 120 minutes, however, the responses from RFID tag 200 are abnormal, or no response comes from RFID tag 200. Print controller 301 therefore determines that RFID tag 200 is not genuine.

The reason for this is as follows. Genuine RFID tag 200 is capable of responding semi-permanently, since genuine RFID tag 200 generates electric power needed for its communication with the RFID reader/writer using the radio wave received from the RFID reader/writer. In contrast, as is often the case, non-genuine RFID tag 200 uses a battery for 30-mA to supply power. The power consumption of a CPU capable of emulation is usually in a range of approximately 50 mA to 60 mA. In this environment, if the communication test using the authentication data continues for 120 minutes including lengths of time needed to transmit the authentication data, non-genuine RFID tag 200 ceases to respond.

Here, descriptions are provided for a modification of the second embodiment. The modification is configured such that: the print controller repeatedly performs the processing from step S103 through step S107 for a predetermined length of time (for example, 120 minutes); but after the predetermined length of time elapses, the print controller does not perform the processing from step S103 through step S107 at all. In other words, until the predetermined length of time elapses after the communication test process starts, the print controller repeatedly transmits the authentication, determines whether the response from RFID tag 200 is normal or abnormal, and whether no response comes from RFID tag 200, as well as thereby determines whether RFID tag 200 is genuine.

The repeated transmission of the authentication data until the predetermined length of time elapses after the communication test process starts is effective, for example, in the case where: genuine RFID tag 200 is operable for 120 minutes or more; and non-genuine RFID tag 200 is operable for less than 120 minutes. Furthermore, this modification is capable of reducing load on image formation apparatus 1 and RFID tag 200.

In the modification, as illustrated in the communication test result in FIG. 12, after the 120 minutes elapses since in step S103, print controller 301 starts to measure the elapsed time, the responses from RFID tag 200 are abnormal, or no response comes from RFID tag 200. The print controller, therefore, determines that RFID tag 200 is not genuine, and terminates the communication test process.

As discussed above, the second embodiment is configured such that the printer controller repeatedly performs the communication test using the authentication data for the predetermined length of time, and determines whether each response from the RFID tag is normal or abnormal, or whether no response comes from the RFID tag. For this reason, from the second embodiment, it is possible to obtain the effect of being capable of: identifying the difference between the genuine RFID tag and the non-genuine RFID tag in terms of their operable time length; and thereby determining whether the RFID tag in question is genuine.

Accordingly, it is possible to obtain an effect of enabling proper maintenance of the image formation apparatus by improving accuracy of determining whether the replacement unit on which the RFID tag in question is mounted is genuine.

Although the foregoing descriptions are provided for the first and second embodiments in which the image formation apparatus is the intermediate transfer-type printer, the image formation apparatus is not limited to this one. The image formation apparatus may be a direct transfer-type printer, a copy machine, a facsimile machine, a multifunctional printer (MFP).

In addition, the power supply unit (for example, output buffer circuit 222) may contactlessly apply electric power to the first communication part (for example, RFID tag 200) using a radio wave, electromagnetic coupling, or electromagnetic induction.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a replacement unit that is detachably attachable to a body of the image formation apparatus and includes a first communication part capable of communicating wirelessly;

a second communication part configured, in a state where the replacement unit is attached to the body of the image formation apparatus, to communicate wirelessly with the first communication part; and a control unit configured to control the second communication part, wherein in a process of causing the second communication part to communicate wirelessly with the first communication part a plurality of times, the control unit detects a change in a response from the first communication part, the second communication part includes a power supply unit configured to supply electric power to the first communication part, the control unit controls the power supply unit such that a power amount supplied by the power supply unit is changed from a first power amount to a second power amount, and makes a determination on the replacement unit including the first communication part based on the communication from the first communication part under condition that the power amount is changed, and in a process of changing the power amount supplied by the power supply unit to a smaller amount, the control unit detects the response from the first communication part changing from a normal response to an abnormal response or no response.

2. The image formation apparatus according to claim 1, wherein the control unit controls the power supply unit such that the power amount supplied by the power supply unit is gradually changed from the first power amount to the second power amount, and makes the determination on the replacement unit including the first communication part based on the communication from the first communication part under condition that the power amount is gradually changed.

3. The image formation apparatus according to claim 1, wherein in a condition where the power amount supplied by the power supply unit is larger than a predetermined power amount, if the control unit detects a change in the response from the first communication part, the control unit determines that the first communication part is not genuine.

4. The image formation apparatus according to claim 1, wherein in a condition where the power amount supplied by the power supply unit is smaller than a predetermined power amount, if the control unit detects a change in the response from the first communication part, the control unit determines that the first communication part is not genuine.

5. The image formation apparatus according to claim 1, wherein the electric power supplied to the first communication part is electric power to be consumed by the first communication part.

6. The image formation apparatus according to claim 1, wherein the control unit causes the second communication part to transmit an authentication instruction to the first communication part, and detects a change in the response from the first communication part.

7. The image formation apparatus according to claim 1, wherein the control unit changes the power amount supplied by the power supply unit to the first communication part by decreasing the power amount in steps, and detects a change in the response from the first communication part at each of the steps of decreasing the power amount.

8. The image formation apparatus according to claim 1, wherein the power supply unit supplies the electric power to the first communication part by a radio wave transmitted from the second communication part to the first communication part, and the control unit changes the power amount supplied by the power supply unit to the first communication part, by changing an amplitude of the radio wave to be transmitted to the first communication part.

9. An image formation apparatus comprising:

a replacement unit detachably attachable to a body of the image formation apparatus and including a first communication part capable of communicating wirelessly;

a second communication part configured, in a state where the replacement unit is attached to the body of the image formation apparatus, to communicate wirelessly with the first communication part; and a control unit configured to control the second communication part, wherein in a process of causing the second communication part to communicate wirelessly with the first communication part a plurality of times, the control unit detects a change in a response from the first communication part, and at predetermined time intervals after the second communication part starts to transmit information to the first communication part, the control unit detects whether the response from the first communication part changes, and makes a determination on the replacement unit including the first communication part based on the detection result.

10. The image formation apparatus according to claim 9, wherein if the control unit detects the change in the response from the first communication part, the control unit determines that the first communication part is not genuine.

11. The image formation apparatus according to claim 9, wherein the change in the response is a change in the response from the first communication part from a normal response to an abnormal response or no response.

12. The image formation apparatus according to claim 9, wherein until a predetermined length of time longer than the time interval elapses after the second communication part starts to transmit the information to the first communication part, the control unit causes the second communication part to transmit the information.

13. The image formation apparatus according to claim 9, wherein the information is an authentication instruction.

14. An image formation apparatus comprising:

an engagement part to which a replacement unit with a first communication part is detachably attachable;

a second communication part configured, in a state where the replacement unit is attached to the engagement part, to communicate wirelessly with the first communication part of the replacement unit; and a control unit programmed to control the second communication part, wherein in a process of causing the second communication part to communicate wirelessly with the first communication part a plurality of times, the control unit detects a change in a response from the first communication part, the second communication part includes a power supply unit configured to supply electric power to the first communication part, the control unit controls the power supply unit such that a power amount supplied by the power supply unit is changed from a first power amount to a second power amount, and makes a determination on the replacement unit including the first communication part based on the communication from the first communication part under condition that the power amount is changed, and in a process of changing the power amount supplied by the power supply unit to a smaller amount, the control unit detects the response from the first communication part changing from a normal response to an abnormal response or no response.

15. The image formation apparatus according to claim 14, wherein the control unit controls the power supply unit such that the power amount supplied by the power supply unit is gradually changed from the first power amount to the second power amount, and makes the determination on the replacement unit including the first communication part based on the communication from the first communication part under condition that the power amount is gradually changed.

16. The image formation apparatus according to claim 14, wherein the control unit changes the power amount supplied by the power supply unit to the first communication part by decreasing the power amount in steps, and detects a change in the response from the first communication part at each of the steps of decreasing the power amount.

17. The image formation apparatus according to claim 14, wherein the power supply unit supplies the electric power to the first communication part by a radio wave transmitted from the second communication part to the first communication part, and the control unit changes the power amount supplied by the power supply unit to the first communication part, by changing an amplitude of the radio wave to be transmitted to the first communication part.

18. An image formation apparatus comprising:

an engagement part to which a replacement unit with a first communication part is detachably attachable;

a second communication part configured, in a state where the replacement unit is attached to the engagement part, to communicate wirelessly with the first communication part of the replacement unit; and a control unit programmed to control the second communication part, wherein in a process of causing the second communication part to communicate wirelessly with the first communication part a plurality of times, the control unit detects a change in a response from the first communication part, at predetermined time intervals after the second communication part starts to transmit information to the first communication part, the control unit detects whether the response from the first communication part changes, and makes a determination on the replacement unit including the first communication part based on the detection result.

* * * * *